United States Patent [19]

Heider

[11] 4,181,444

[45] Jan. 1, 1980

[54] DEVICE FOR PRINTING OUT INDICES AND POWERS IN TYPEWRITERS

[75] Inventor: Ulrich Heider, Munich, Fed. Rep. of Germany

[73] Assignee: Siemens Aktiengesellschaft, Berlin & Munich, Fed. Rep. of Germany

[21] Appl. No.: 841,527

[22] Filed: Oct. 12, 1977

[30] Foreign Application Priority Data

Oct. 18, 1976 [DE] Fed. Rep. of Germany ..... 2646964

[51] Int. Cl.[2] ..... B41J 19/76

[52] U.S. Cl. ..... 400/568; 400/904; 400/65; 400/551; 400/555

[58] Field of Search ..... 400/65, 551, 555, 568, 400/900, 902, 904

[56] References Cited

U.S. PATENT DOCUMENTS

| | | | |
|---|---|---|---|
| 3,534,847 | 10/1970 | Willcox | 400/568 X |
| 3,858,704 | 1/1975 | Kawano et al. | 400/568 X |
| 3,872,959 | 3/1975 | Wang et al. | 400/65 |
| 3,927,752 | 12/1975 | Jones et al. | 400/904 |
| 3,947,853 | 3/1976 | Denny et al. | 400/904 X |
| 4,037,705 | 7/1977 | Martin et al. | 400/902 X |

FOREIGN PATENT DOCUMENTS

| | | | |
|---|---|---|---|
| 2257412 | 5/1973 | Fed. Rep. of Germany | 400/568 |
| 2225022 | 11/1973 | Fed. Rep. of Germany | 400/568 |
| 589673 | 6/1925 | France | 400/904 |
| 114931 | 9/1945 | Sweden | 400/904 |

*Primary Examiner*—Ernest T. Wright, Jr.
*Attorney, Agent, or Firm*—Hill, Van Santen, Steadman, Chiara & Simpson

[57] ABSTRACT

A device is disclosed for index and exponent impression printing in typewriters. An exponent or index switching key has associated with it an edge detector, and parallel thereto, a state detector. A time function element which triggers a gate circuit for the triggering of the drive motor for the roller is connected behind the edge detector. A rotational direction reversal switching device is connected behind the state detector. The device is useful in office typewriters, data printers or telex machines not equipped with their own exponent or index printing symbols.

5 Claims, 2 Drawing Figures

DEVICE FOR PRINTING OUT INDICES AND POWERS IN TYPEWRITERS

BACKGROUND OF THE INVENTION

1. Field of the Invention

The invention relates to a device for electric typewriters or the like with a type carrier which can be triggered via a keyboard for row-by-row print out on a data carrier which is displaceable relative to the type carrier.

2. Description of the Prior Art

In order to print out powers and indices on typewriters, it is known to effect an offset print out by turning the typewriter roller or typing surface manually or, in the case of electric typewriters, by triggering the half-line circuit preceding and following the character.

This manual actuation of the roller or triggering of the half-line circuit leads to a considerable disturbance of the typing operation and is found to be extremely burdensome by the operator as, in particular when it is forgotten to effect a switch-back following the offset print out, the typing error rate increases.

In electric typewriters it is known from the Deutsches Industrie Normalformat sheet 2137 (German Industry Norm) to arrange an additional key in the typewriter keyboard, with the aid of which key it is possible to type powers, although the symbols are restricted to those designated on the key. In this case the print out is effected with the aid of special types which bear the powers. As a result it is necessary to extend the character supply of the type carrier by these additional symbols.

SUMMARY OF THE INVENTION

An object of the invention is, in particular for electric typewriters, to make available a device which facilitates a mechanical typing of powers and indices and of arbitrary character sequences offset in the upwards or downwards direction relative to the normal row of type.

This object is realized in accordance with the invention in that a control device is provided which can be triggered via a signal designating an index or power, and which produces a print out which is offset parallel to the row of type and which can be adjusted in width in dependence upon the line spacing.

In a particularly advantageous embodiment of the invention, at least one special operating element which serves to trigger the control device is provided in the keyboard. In this case an offset print out is effected solely for the duration of the actuation of the operating element.

The invention has the great advantage that when the operating element is actuated, any character which is subsequently struck can be typed as a power. In dependence upon the adjusted line spacing, the offset of the power to be typed will differ, which has a positive effect upon the layout. It is unnecessary to additionally employ symbols on the type carrier.

As the offset print out is effected during the time in which the operating element is depressed, similarly as in the case of upper case typing the possibility of forgetting to reset the typing surface is ruled out. In order to be able to type both powers and indices, in an advantageous further development of the invention a separate operating element is provided both for the downwards offset print out and for the upwards offset print out. In this way the typing of mathematical-scientific texts is considerably simplified.

DESCRIPTION OF THE PREFERRED EMBODIMENTS

Figure 1:
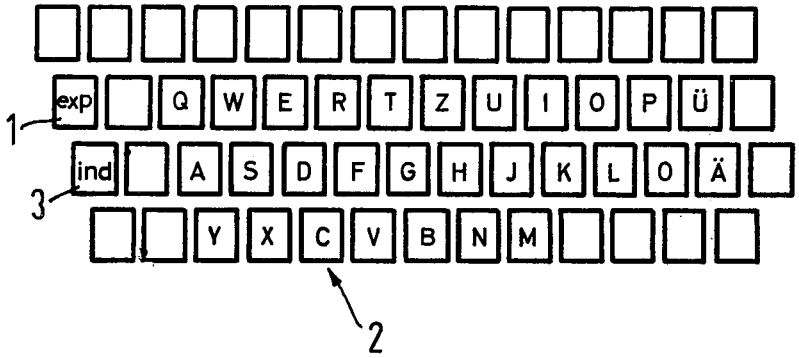
FIG. 1 illustrates a keyboard panel with the additional operating elements.
Figure 2:
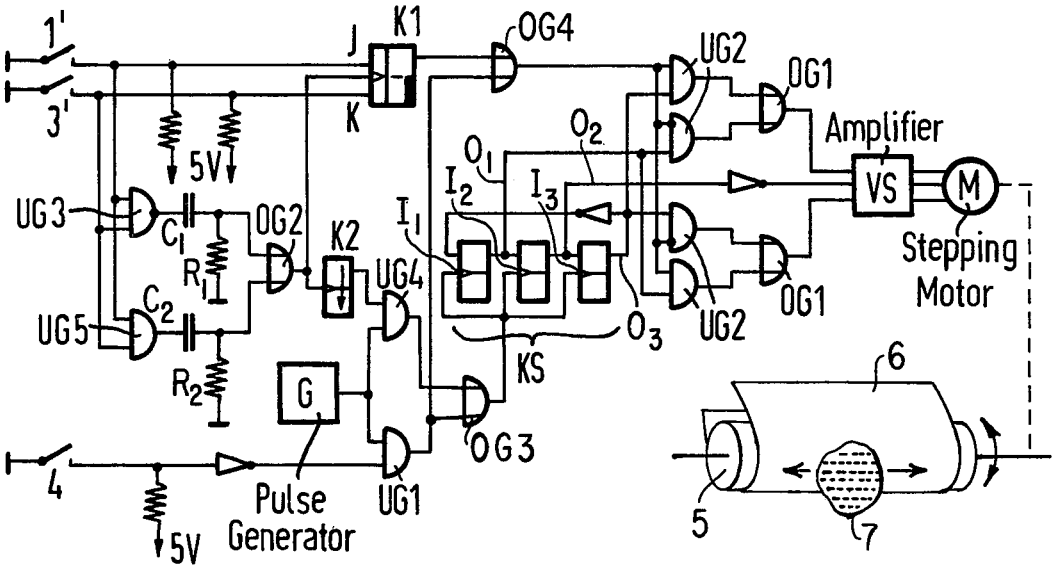
FIG. 2 illustrates a circuit arrangement for the appropriate drive of a stepping motor.

In the typewriter keyboard illustrated in FIG. 1 which corresponds to DIN 2137 (German Industry Norm), in accordance with the invention a key 1 is provided as an operating element for typing powers (superscripts). When this key 1 is depressed, the typing surface or roller 5 is turned forwards by a specific angle, as a result of which all the keys now depressed in the keyboard 2 produce a print out by a type carrier 7 offset relative to the typed line on the data carrier 6. This offset print out continues until the operating element 1 is released again, and thus the roller 5 returns to its basic position.

In order to facilitate the typing of indices (subscripts) in addition to that of powers, in a particularly advantageous embodiment of the invention, in addition to the operating element or key 1 there is provided a further operating element or key 3, in which case the one operating element or key 1 facilitates an upwards offset print out, and the other operating element or key 3 facilitates a downwards offset print out.

The actual mechanism which causes the roller 5 to be offset when the operating elements or keys 1, 3 are actuated can, similar to the line feed mechanism in printers described in the German OS 2 225 022, or similarly to the line spacing device described in the German OS 2 257 412, be designed for power-driven typing calculating accounts or similar machines.

A pulse generator G produces the drive pulse trains with which the stepping motor M which drives the roller 5 can be operated. With a normal row-wise feed via the symbolically represented switch path 4, for the duration of the feed the AND logic link element UG1 is connected to a logic 1, so that the generator pulse train from the generator G is applied through an OR gate OG3 to the pulse train inputs $I_1$, $I_2$, $I_3$ of the three-stage row of trigger or flip-flop stages KS. Outputs $O_1$, $O_2$, $O_3$ of the trigger stages KS drive the stepping motor M via a series of AND gates UG2 (functioning as a reversing switching circuit), OR-gates OG1, and an amplifier circuit VS.

If an index is to be printed within a row, for this period of time the symbolic contact 3' is closed. When this contact 3' is closed due to the logic 1 which occurs at the inverting output of the NAND gate UG3, the following $R_1C_1$ element functioning as an edge detector detecting closing of the contacts 3' supplies a pulse via the OR gate OG2, by way of a control pulse train, both to a bistable trigger or flip-flop stage K1 serving as a state detector and to a monostable trigger or flip-flop switching stage K2 serving as a time element. As a logic 1 is applied to the upper input J of the JK trigger stage K1 and a logic 0 is applied to the K input of this trigger stage K1, the trigger stage K1 is set to the non-inverting output. This provides the criterion through OR gate OG4 for the direction of movement during normal feed. At the same time the monostable trigger stage K2 is set, which, via the AND gate UG4, releases the requisite number of pulses from the pulse generator G of the row of trigger stages KS to drive the stepping motor M. When the contact 3' is opened again, via the AND gate UG5 and the adjoining $R_2C_2$ element serving as an edge detector for detecting opening of the contact 3' a pulse is produced which is again fed to the JK trigger stage K1 and to the monostable trigger stage K2. As the JK trigger stage K1 now triggers into its reverse position, a criterion exists through OR gate OG4 for a backwards movement of the stepping motor M, which now receives the same number of timing pulses from the pulse generator G for backwards setting.

The stepping motor M is driven via the power key 1 in a similar fashion via the index key 3 with the difference that, when the power key 1 is closed, the JK trigger stage K1 is operated at the K input so that a criterion exists for turning the stepping motor M backwards. When the power key 1 is opened the JK trigger stage K1 triggers back into the other position so that now the stepping motor M can again be adjusted in the forwards direction.

Although the teachings of my invention have herein been discussed with reference to specific theories and embodiments, it is to be understood that these are by way of illustration only and that others may wish to utilize my invention in different designs or applications.

I claim as my invention:

1. A device for power-driven typing, calculating, and similar machines with a type carrier which can be triggered via a keyboard and which serves for row-by-row print out on a data carrier which is displaceable row-by-row relative to the type carrier by use of a stepping drive motor connected to a support means supporting the data carrier, comprising: a power switching means and an index switching means each controlling an edge detector means for producing a triggering pulse in response to the closing or opening of the switching means and, in parallel therewith, a state detector means for controlling a rotation direction of the drive motor; the edge detector means being connected to the state detector means and to a time element which drives gate circuit means for the drive of the drive motor; and the state detector means connecting to reversing switching means for the drive motor.

2. A device as claimed in claim 1, characterized in that a JK flip-flop stage is provided for the state detector means whose pulse train input is connected to an output of the edge detector means.

3. A device as claimed in claim 1, characterized in that the time element comprises a monostable flip-flop stage whose output leads to the input of an AND gate and whose other input is connected to a pulse generator pulse train line.

4. The device of claim 1 in which said edge detector means comprises first and second RC pulse producing circuits.

5. An apparatus for power-driven typing and calculating machines with a type carrier which can be triggered via a keyboard and which serves for row-by-row print out on a data carrier which is supported and displaceable row-by-row by a rotatable support, comprising:

(a) a stepping drive motor connected to the rotatable support;
(b) a superscript activation key on the keyboard;
(c) a subscript activation key on the keyboard;
(d) bistable state detector means controlled by said superscript and subscript keys for determining a direction of rotation of said drive motor;
(e) rotation direction switching means connected to said bistable state detector means;
(f) a time element comprising a monostable switching means for permitting a predetermined number of drive pulses to be supplied by pulse generator means to the drive motor when the superscript or subscript keys are activated; and
(g) edge detector means connected for triggering the bistable state detector means and monostable switching means and for producing a triggering pulse when the activation keys are activated and deactivated.

* * * * *